US005129932A

United States Patent [19]

Agrawal et al.

[11] Patent Number: 5,129,932

[45] Date of Patent: Jul. 14, 1992

[54] CRYOGENIC PROCESS FOR THE SEPARATION OF AIR TO PRODUCE MODERATE PRESSURE NITROGEN

[75] Inventors: Rakesh Agrawal, Allentown; Donald W. Woodward, New Tripoli, both of Pa.

[73] Assignee: Air Products and Chemicals, Inc., Allentown, Pa.

[21] Appl. No.: 785,596

[22] Filed: Oct. 30, 1991

Related U.S. Application Data

[62] Division of Ser. No. 537,181, Jun. 12, 1990, Pat. No. 5,077,978.

[51] Int. Cl.[5] ..... F25J 3/04; F25J 3/02

[52] U.S. Cl. ..... 62/22; 62/25; 62/27; 62/31; 62/34

[58] Field of Search ..... 62/22, 24, 27, 31, 34

[56] References Cited

U.S. PATENT DOCUMENTS

| | | | |
|---|---|---|---|
| 4,575,388 | 3/1986 | Okada | 62/22 |
| 4,715,873 | 12/1987 | Auvil et al. | 62/22 X |
| 4,747,859 | 5/1988 | Gladman et al. | 62/22 |
| 4,783,208 | 11/1988 | Rathbone | 62/22 |
| 4,790,866 | 12/1988 | Rathbone | 62/22 |
| 4,822,395 | 4/1989 | Cheung | 62/22 |
| 4,824,453 | 4/1989 | Rottmann et al. | 62/22 |
| 4,836,836 | 6/1989 | Bennett et al. | 62/22 |
| 4,838,913 | 6/1989 | Victor et al. | 62/22 |
| 4,842,625 | 6/1989 | Allan et al. | 62/34 X |
| 4,854,954 | 8/1989 | Erickson | 62/22 |
| 4,871,382 | 10/1989 | Thorogood et al. | 62/34 |
| 4,936,099 | 6/1990 | Woodward et al. | 62/24 |
| 4,977,746 | 12/1990 | Grenier et al. | 62/22 |
| 5,034,043 | 7/1991 | Rottmann | 62/22 |

*Primary Examiner*—Henry A. Bennet
*Assistant Examiner*—Christopher B. Kilner
*Attorney, Agent, or Firm*—Russell L. Brewer; James C. Simmons; William F. Marsh

[57] ABSTRACT

This invention relates to a cryogenic process for the separation of air utilizing an integrated multi-column distillation system wherein a nitrogen rich, oxygen rich and argon rich product are generated. In the cryogenic distillation separation of air, air is initially compressed, pretreated and cooled for separation into its components. Moderate pressure, e.g., 25–80 psia nitrogen is generated with enhanced nitrogen product purity and greater recovery of both nitrogen and argon by effecting a high boil-up rate in the bottom of the lower pressure column, thereby creating a reduced liquid flow/vapor flow ratio (L/V) and utilizing a higher than customary nitrogen reflux to the top of the lower pressure column, where the concentration of oxygen in nitrogen is less than about 10 ppm by volume or the nitrogen purity is at least about 99.5% by volume.

Refrigeration to drive the system is obtained by recovering the energy from the waste nitrogen stream and oxygen vapor from the lower pressure column.

A second method for obtaining refrigeration is to withdraw oxygen as a bottoms liquid from the lower pressure column, expanding that liquid to a lower pressure and using it to condense the nitrogen vapor generated in a higher pressure column which has been expanded in a turbo-expander to provide the refrigeration.

1 Claim, 2 Drawing Sheets

CGAR
GAN
74
AIR
10
$O_2$-RICH
68
MAIN
HEAT
EXCHANGER
30
70
82
212
214
100
96
206
58
94
56
54
52
98
204
20
208
60
24
26
28
80
202
12
50
62
210
63
200
216
64
66
72

CGAR
GAN
AIR
$O_2$-RICH
MAIN HEAT EXCHANGER
62
210
63
100
96
206
214
212
98
58
94
82
28
80
50
27
220
24
60
208
30
204
20
202
59
61
63
218
216
25
23
200
21
68

CRYOGENIC PROCESS FOR THE SEPARATION OF AIR TO PRODUCE MODERATE PRESSURE NITROGEN

This is a division of application Ser. No. 07/537,181, filed Jun. 12, 1990, now U.S. Pat. No. 5,077,978.

TECHNICAL FIELD OF THE INVENTION

This invention relates to cryogenic process for the separation of air and recovering moderate pressure nitrogen with high argon recovery.

BACKGROUND OF THE INVENTION

Numerous processes are known for the separation of air by cryogenic distillation into its constituent components. Typically, the air separation process involves removal of contaminant materials such as carbon dioxide and water from a compressed air stream prior to cooling to near its dew point. The cooled air then is cryogenically distilled in an integrated multi-column distillation system having a high pressure column, a low pressure column and a side arm column for the separation of argon. The side arm column for the separation of argon typically communicates with the low pressure column in that an argon/oxygen stream containing about 8–12% argon is removed and cryogenically distilled in the side arm column. A waste nitrogen stream is generated to control nitrogen purity, U.S. Pat. Nos. 4,871,382; 4,836,836 and 4,838,913 are representative.

Recent attempts to improve the argon recovery at reduced power costs involved the use of structured and other forms of packing in the lower section of the low pressure column. The packings minimize pressure drop in the low pressure column and thereby take advantage of the increased relative volatility between nitrogen and argon at low pressure, thereby minimizing power consumption, as compared to column performance where trays are used as the vapor-liquid contact medium. U.S. Pat. No. 4,836,836 is representative.

One type of the more conventional cryogenic air separation processes calls for the operation of the low pressure column at a pressure ranging from about 14–20 psia, with the side arm column for argon separation operating at slightly lower pressure. The pressure utilized in the lower pressure column is such that nitrogen and argon product specifications can be met with maximum recovery of the components. Operating pressure is also indicative of power consumption in the cryogenic distillation process and is a major concern; operating pressures are selected to minimize power consumption. Therefore, the overall process design focuses on product specification, product recovery and power consumption.

Conventional multi-column system processes generate low pressure (15–20 psia) nitrogen product streams at high recovery while permitting efficient separation of argon. Recently there has been increased interest in generating moderate pressure nitrogen from a cryogenic distillation process, because of increased demand for inert atmospheres and enhanced oil recovery. Moderate pressure, e.g., pressures ranging from about 25–80 psia nitrogen, are generated by operating the low pressure nitrogen column at higher pressures than are utilized in conventional cryogenic air separation. The increased pressure in the low pressure column creates a problem with respect to the separation of argon from oxygen and nitrogen, because the relative volatility between argon and oxygen and between nitrogen and argon is reduced, thus making recovery of argon more difficult. The advantage achieved by low pressure column operation where the relative volatilities between argon and oxygen, and nitrogen and argon are large are reduced when this system is adapted by increasing the pressure of the low pressure column to moderate pressure inhibiting separation of the oxygen and nitrogen from the argon, and therefore recovery of argon, is lost.

One approach for producing moderate pressure nitrogen with high argon recovery is set forth in U.S. Pat. No. 4,822,395. That approach involves, inter alia, driving the argon column top condenser with the low pressure column bottoms as opposed to conventional processes wherein the argon column condenser is driven with the bottoms from the high pressure column. By utilizing the low pressure column bottoms to drive the argon column top condenser, a greater amount of high pressure bottoms may be used to provide reflux to the low pressure column. The introduction of the high pressure bottoms as reflux to the low pressure column at a point above the argon withdrawal point to the side arm column forces the argon downward toward the withdrawal point thereby enhancing recovery of argon from the system.

SUMMARY OF THE INVENTION

This invention relates to an air separation process and to the apparatus for effecting such air separation. In the basic process, air comprising nitrogen, oxygen and argon is compressed and cooled to near its dew point generating a feed for cryogenic distillation. Distillation is effected in an integrated multi-column distillation system having a higher pressure column, a lower pressure column and a side arm column for argon separation with the side arm column communicating with the lower pressure column. A nitrogen rich product, an argon rich product and an oxygen rich product are generated in this multi-column distillation system. The improvement in this basic process for producing moderate pressure nitrogen product while enhancing argon recovery generally comprises:

establishing and maintaining a liquid to vapor ratio in the bottom of the lower pressure column of less than about 1.4; and establishing and maintaining a nitrogen reflux ratio in the upper section of the lower pressure column of greater than about 0.5, wherein the nitrogen reflux comprises at least 99.5% and preferably 99.8% nitrogen by volume.

DRAWINGS

DETAILED DESCRIPTION OF THE INVENTION

It has been found that the problems associated with a generation of moderate pressure nitrogen product from a lower pressure column in an integrated-multi column distillation system due to the reduction in relative volatilities between argon and oxygen and nitrogen and argon, particularly oxygen from argon, are overcome by generating a higher "boil-up" in the bottoms of the lower pressure column, as compared to a conventional cycle. The increased boil-up reduces the liquid flow to vapor flow ratio (L/V) in the bottom section and aids in effecting separation of the components within the bottoms portion of the lower pressure column. By reducing the L/V in the bottom portion of the lower pressure column separation of the argon and nitrogen from the oxygen constituent in the air stream is enhanced. The utilization of a higher level of nitrogen reflux in the lower pressure column having a higher nitrogen concentration greater than about 99.5%, preferably 99.8% by volume, forces argon downwardly in the column toward the withdrawal point.

Figure 1:
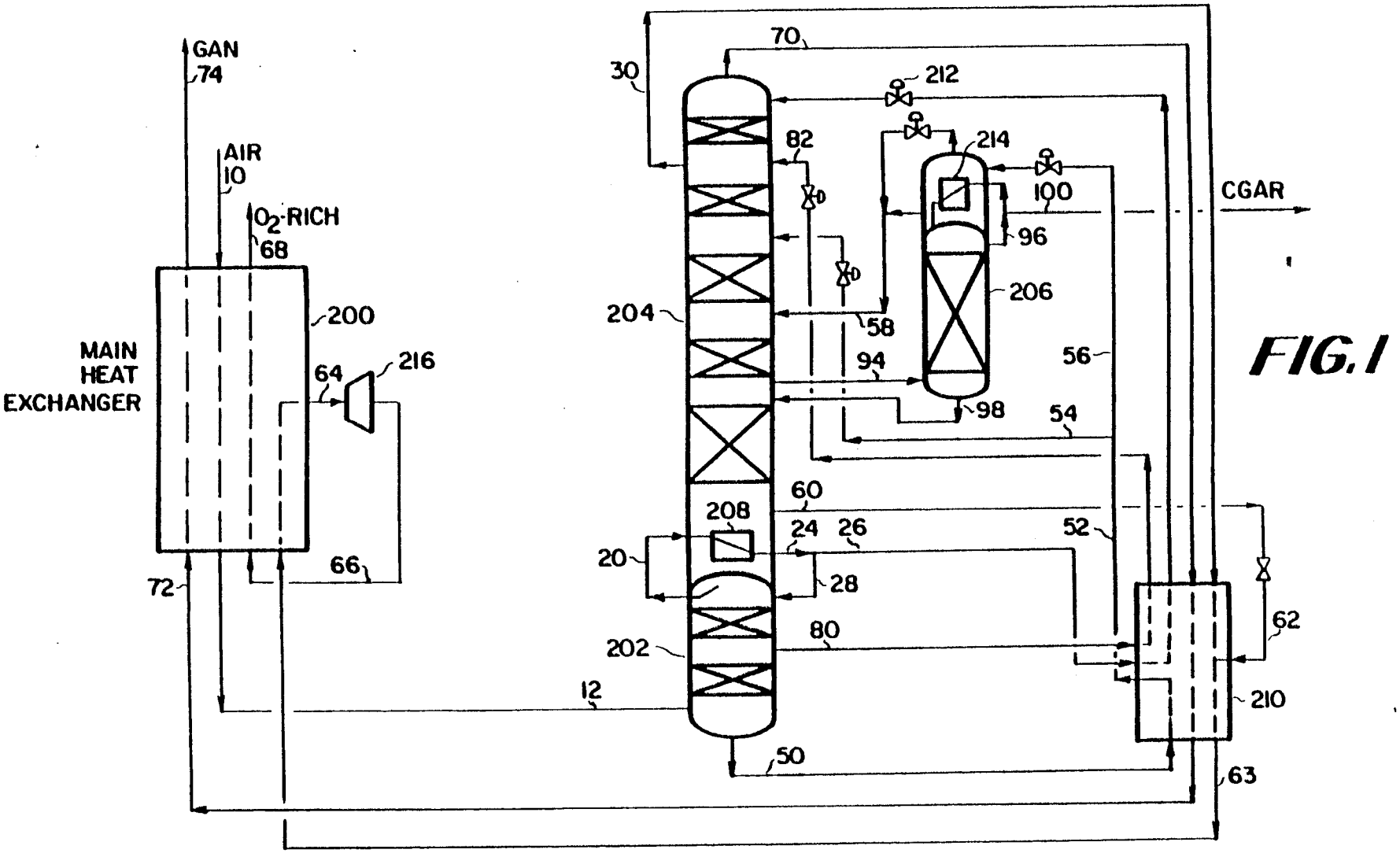
FIG. 1 is a schematic representation of an embodiment for generating moderate pressure nitrogen with enhanced argon recovery wherein essentially all of the nitrogen vapor in the higher pressure column is directly used to effect boil-up in the lower pressure column and then as reflux for the lower and higher pressure column and refrigeration is obtained from oxygen vapor in the low pressure column.

To facilitate an understanding of the invention and the concepts for generating a reduced L/V in bottom section of the the lower pressure column with enhanced high purity nitrogen reflux, reference is made to FIG. 1. More particularly, a feed air stream 10 is initially prepared from an air stream for separation by compressing an air stream comprising oxygen, nitrogen, argon and impurities, such as, carbon dioxide and water in a multistage compressor system to a pressure ranging from about 80 to 300 psia and typically in the range of 90–180 psia. This compressed air stream is cooled with cooling water and chilled against a refrigerant and then passed through a molecular sieve bed to free it of water and carbon dioxide contaminants.

Stream 10, which is free of contaminants, is cooled to near its dew point in main heat exchanger 200, which forms the feed via stream 12 to an integrated multi-column distillation system, comprising a high pressure column 202, a low pressure column 204 and a side arm column 206 for effecting argon separation. High pressure column 202 is operated at a pressure close to the pressure of feed air stream 10 and air is separated into its components by intimate contact with vapor and liquid in the column. High pressure column 202 is equipped with distillation trays or packings, either medium being suited for effecting liquid/vapor contact. A high pressure nitrogen vapor stream is generated at the top portion of high pressure column 202 and a crude liquid oxygen stream is generated at the bottom of high pressure column 202.

Low pressure column 204 is operated within a pressure range from about 25–90 psia and preferably in the range of about 25 to 50 psia in order to produce moderate pressure nitrogen-rich product. The objective in the lower pressure column is to provide high purity nitrogen vapor, e.g., greater than 99.5% preferably 99.8% by volume purity at the top of the column, with minimal argon loss and to generate a high purity oxygen stream. However, in most cases, oxygen recovery is of secondary importance. Low pressure column 204 is equipped with vapor liquid contact medium which comprises distillation trays or a structured packing. An argon sidestream is removed from the lower pressure column 204 via line 94 to side arm column 206 which typically operates at a pressure close to the low pressure column pressure. An argon-rich stream is removed from the top of the side arm column 206 as a product.

In operation, substantially all of the high pressure nitrogen vapor generated in high pressure column 202 is withdrawn via line 20 and condensed in reboiler/condenser 208 providing increased boil-up and thereby establishing a lower liquid flow to vapor flow ratio (L/V) than is normally utilized in the lower portion of column. This L/V is therefore less than about 1.4 and often as low as 1.35 or lower. Conventional cycles typically used a portion of the feed air for refrigeration purposes. Because substantially all of the cooled feed air is introduced to high pressure column 202, increased levels of nitrogen vapor are generated in the top of high pressure column 202 per unit of air compressed and introduced via line 20 as compared to conventional cycles and thus available for effecting reboil in low pressure column 204. When the L/V is greater than about 1.45, the argon/oxygen separation is less efficient at the increased pressure of the low pressure column used here. The condensed nitrogen is withdrawn from reboiler/condenser 208 via line 24 and split into two portions with one portion being redirected to high pressure column 202 as reflux via line 28. The balance of the high pressure nitrogen is removed via line 26, cooled in heat exchanger 210, isenthapically expanded in JT valve 212 and introduced to the top of the low pressure column 204 as reflux to the column. Since a larger quantity of nitrogen is condensed in reboiler/condenser 208, a larger flow is available in line 26 for utilization as reflux to the low pressure column. The utilization of this high purity nitrogen reflux, e.g., greater than about 99.5%, preferably 99.8% nitrogen, by volume, and utilization of a nitrogen reflux ratio greater than about 0.5 and often up to about 0.55 in the top section facilitates the argon/nitrogen separation in low pressure column 204.

Depending upon argon recovery specifications, an impure nitrogen stream may be removed from high pressure column 202 via line 80, subcooled, reduced in pressure and then introduced to low pressure column 204 as impure reflux. The less pure nitrogen used as reflux tends to reduce the recovery of argon in the system, and reduces the level of nitrogen reflux provided via line 26 to the top of low pressure column 204.

The utilization of a high nitrogen reflux ratio and high purity nitrogen supplied to the top of the low pressure column 204 via line 26 forces the argon downwardly in column 204, increasing the concentration at the point of withdrawal via line 94 and thereby enhancing recovery. An argon containing vapor having a concentration of from about 8 to 12% argon is removed from the intermediate point in low pressure column 204 via line 94 and charged to side arm column 206 for separation. Argon is separated from oxygen in side arm column 206 and a bottoms fraction rich in oxygen is withdrawn from the bottom of column 206 and returned via line 98 to low pressure column 204. Side arm column 206, like high pressure column 202 and low pressure column 204, is equipped with vapor-liquid contact medium such as trays or packing. An argon rich stream is removed from the side arm column 206 via line 96, wherein it is split into two portions, one portion being used to supplement the driving of reboiler/condenser 214 in the top of the column. The balance of the stream is removed via line 100 and recovered as a crude gaseous argon stream containing at least 97% argon by volume.

A nitrogen rich product stream is removed from the top of low pressure column 204, via line 70, wherein it is warmed against other process fluids in heat exchangers 210 and 200, the nitrogen vapor stream being removed from heat exchanger 210 via line 72 and from heat exchanger 200 via line 74. Nitrogen purity in product vapor stream 70 is controlled via a waste nitrogen stream removed from an upper portion of low pressure column 204 via line 30. It is at this point that argon losses occur in the moderate pressure nitrogen distillation system. By control exercised as described, losses through line 30 are minimized.

Refrigeration for the cycle in FIG. 1 is accomplished by what we refer to as the direct method. High pressure crude liquid oxygen (LOX) is withdrawn from high pressure column 202 via line 50, cooled in heat exchanger 210 to a subcooled temperature and withdrawn via line 52 wherein it is split into two fractions. One fraction is removed via line 54 and charged to low pressure column 204 as reflux, the reflux being added at a point above the point of withdrawal for the argon removal i.e., line 94 and the other withdrawn via line 56 and vaporized in reboiler/condenser to 214. The vaporized crude liquid oxygen stream is withdrawn via line 58 and fed to the low pressure column at a point below the feed tray for subcooled liquid oxygen stream 54. Since a larger amount of nitrogen is condensed in reboiler/condenser 208, a larger amount of liquid nitrogen is returned via line 28 to the high pressure column as compared to the conventional processes. This yields a larger liquid flow of crude LOX in line 50 which leads to a larger liquid flow in line 54 to the low pressure column. As compared to the conventional process, this increases the liquid flow in the upper to middle section of the low pressure column and further helps to drive argon down the low pressure column towards feed line 94 to the side arm column 206. This enhances the argon recovery.

To accomplish increased boil-up in low pressure column 204 thereby maintaining a low L/V in the bottom and permitting high reflux with a high nitrogen content to low pressure column 204, additional refrigeration is provided by means of extracting energy from the waste nitrogen stream and oxygen stream. In this regard, the waste nitrogen stream is withdrawn from low pressure column 204 via line 30 and warmed against process fluids. An oxygen rich vapor stream is withdrawn from the bottom of low pressure column 204 via line 60, expanded, and combined with the waste nitrogen stream in line 30. The resulting combined mixture is then warmed in heat exchanger 210 and in heat exchanger 200 prior to work expansion and then after expansion further warming in heat exchanger 200 against incoming air stream 10. Preferably, the expansion of the combined stream is carried out isentropically in turbo-expander 216. In a preferred embodiment, expansion in turbo-expander 216 is effected isentropically with the work generated by the isentropic expansion used to compress a suitable stream at the warm end of the heat exchanger 200. Such a system is often referred to as a compander, wherein the expander and compressor are linked together with the energy obtained from expansion used to compress an incoming stream. In a preferred mode, the oxygen stream to be expanded can be warmed in heat exchanger 200, compressed in the compander, cooled with cooling water, and then partially recooled in heat exchanger 200 prior to being fed to turbo-expander 216. This results in reducing the quantity of oxygen required for refrigeration or reduces the pressure ratio across the expander. An oxygen rich stream is withdrawn from heat exchanger 200 via line 68 for possible use.

Figure 2:
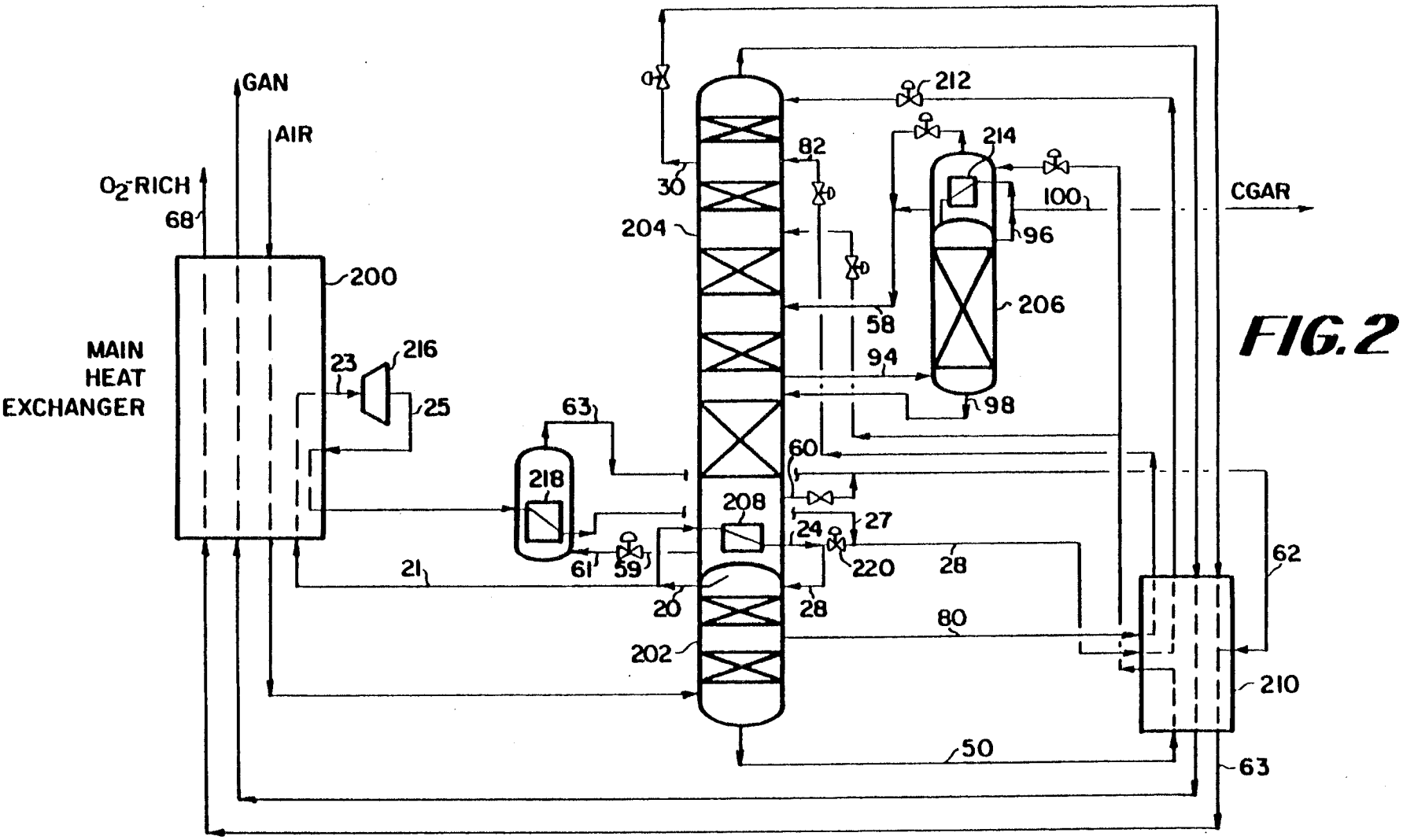
FIG. 2 is a schematic represention of a variation of the process in FIG. 1 wherein a portion of the nitrogen vapor from the higher pressure column is warmed and expanded to provide refrigeration and then used to reboil oxygen liquid generated from the bottom section of the low pressure column after the pressure of this withdrawn oxygen liquid is reduced.

FIG. 2 represents a schematic representation of another embodiment for generating the high boil-up with high reflux of high purity nitrogen to the low pressure column. The refrigeration system is referred to as an indirect method as compared to the direct refrigeration method described in FIG. 1. A numbering system similar to that of FIG. 1 has been used for common equipment and streams and comments regarding column operation will be limited to the significant differences between this process and that described in FIG. 1.

As in the process of FIG. 1, a high pressure nitrogen product is removed from high pressure column 202 via line 20. In contrast to FIG. 1, the high pressure nitrogen vapor from high pressure column 202 is split into two portions with one portion being withdrawn via line 21, warmed in heat exchanger 200 and isentropically expanded in turbo-expander 216. The expanded product then is cooled against process fluids in heat exchanger 200 and charged to separate reboiler/condenser 218. If the work generated by isentropic expansion in turbo-expander 216 is used to compress the incoming nitrogen feed to the turbo-expander at the warm end of the main heat exchanger using a compander as described earlier for the direct method, a smaller portion of nitrogen may be removed via line 21 than where the incoming feed is not compressed. The condensed nitrogen that is withdrawn from reboiler/condenser 218 via line 27 is combined with the remaining portion of nitrogen from the top of the high pressure column 202 forming stream 28. As shown, the balance of the stream via line 20 is condensed in reboiler/condenser 208, withdrawn and then a portion isenthalpically expanded in valve 220 prior to combination with the nitrogen in stream 27. This stream then is used as a reflux to the low pressure column 204 and is introduced near the top of the low pressure column 204 for enhancing recovery of argon.

Refrigeration is accomplished via an indirect method by withdrawing, a liquid oxygen stream from the bottoms of low pressure column 204, via line 59, isenthalpically expanding that portion and charging to the vaporizer portion of reboiler/condenser 218 via line 61. The vaporized fraction is withdrawn from the reboiler condenser 218 via line 63 and then combined with a smaller portion of low pressure oxygen vapor generated within low pressure column 204 and removed via line 60. Stream 60 is isenthalpically expanded and combined with stream 63 forming stream 62. The percent of oxygen withdrawn from the bottom of low pressure column 204 via line 61 is greater than 60% of the total oxygen removed from the bottom of the column as represented by combined stream 62.

Further variations of the process described in FIGS. 1 and 2 are envisioned, as for example the generation of a higher purity oxygen stream. This variation could be accomplished by keeping the oxygen stream separate from the waste nitrogen stream removed from the upper portion of low pressure column 204 via line 30. A separate line would keep the oxygen product at a higher purity.

The following examples are provided to illustrate the embodiments of the invention and are not intended to restrict the scope thereof.

EXAMPLE 1

Direct Refrigeration Method for Moderate Pressure Nitrogen

An air separation process using the apparatus described in FIG. 1 was carried out. Table 1 below sets forth the stream numbers with appropriate flow rates and stream properties.

TABLE 1

| Stream | Phase | Temp. °F. | Press. Psia | $N_2$ | Component Flowrate % Moles AR | $O_2$ | Total Flow Moles/Hr |
|---|---|---|---|---|---|---|---|
| 10 | V | 55 | 124 | 78.1 | 0.9 | 21.0 | 100.0 |
| 12 | V | −261 | 122 | 78.1 | 0.9 | 21.0 | 100.0 |
| 20 | V | −278 | 119 | 100.0 | TR | TR | 112.1 |
| 26 | L | −278 | 119 | 100.0 | TR | TR | 43.5 |
| 28 | L | −278 | 119 | 100.0 | TR | TR | 68.6 |
| 30 | V | −309 | 29 | 99.7 | 0.3 | TR | 2.3 |
| 50 | L | −270 | 122 | 61.3 | 1.6 | 37.1 | 56.6 |
| 54 | L | −279 | 122 | 61.3 | 1.6 | 37.1 | 19.4 |
| 56 | L | −279 | 122 | 61.3 | 1.6 | 37.1 | 37.2 |
| 58 | L & V | −296 | 31 | 61.3 | 1.6 | 37.1 | 37.2 |
| 60 | L | −281 | 35 | TR | 0.1 | 99.9 | 21.0 |
| 63 | V | −272 | 28 | 9.1 | 0.4 | 90.5 | 23.3 |
| 70 | V | −310 | 28 | 100.0 | TR | TR | 75.8 |
| 74 | V | 52 | 26 | 100.0 | TR | TR | 75.8 |
| 80 | — | — | — | — | — | — | 0.0 |
| 82 | — | — | — | — | — | — | 0.0 |
| 94 | V | −284 | 32 | TR | 9.8 | 90.2 | 28.3 |
| 96 | V | −293 | 25 | 0.2 | 96.5 | 3.3 | 29.3 |
| 98 | L | −284 | 32 | TR | 6.9 | 93.1 | 27.4 |

TR represents Trace

EXAMPLE 2

Indirect Refrigeration Method for Moderate Pressure Nitrogen

Air was separated in accordance with the process described in FIG. 2 with Table 2 below setting forth the appropriate stream numbers and appropriate flow rates and stream properties.

TABLE 2

| Stream | Phase | Temp. °F. | Psia | $N_2$ | Ar | $O_2$ | Total Flow Moles/Hr. |
|---|---|---|---|---|---|---|---|
| 10 | V | 55 | 124 | 78.1 | 0.9 | 21.0 | 100.0 |
| 12 | V | −261 | 122 | 78.1 | 0.9 | 21.0 | 100.0 |
| 20 | V | −278 | 119 | 100.0 | TR | TR | 112.1 |
| 26 | L | −278 | 119 | 100.0 | TR | TR | 43.5 |

EXAMPLE 3

Comparative Test

Table 3 sets forth a comparison between processes of described in FIGS. 1 and 2 as compared to a moderate nitrogen generating process described in U.S. Pat. No. 4,822,395 wherein the oxygen from the low pressure column is used to drive the reboiler/condenser in the side arm column for effecting separation of argon and the high pressure bottoms from the high pressure column used to provide a substantial proportion of the reflux to the low pressure column.

TABLE 3

| | FIGS. 1 & 2 | U.S. Pat. No. 4,822,395 |
|---|---|---|
| *Product Recoveries (%) | | |
| Argon | 94.4 | 92.7 |
| Nitrogen | 97.3 | 94.6 |
| Oxygen | 99.9 | 99.9 |
| Product Purities (Moles %) | | |
| Argon | 96.7 | 97.3 |

TABLE 3-continued

| | FIGS. 1 & 2 | U.S. Pat. No. 4,822,395 |
|---|---|---|
| Nitrogen | 99.98 | >99.98 |
| Oxygen | 99.9 | 99.75 |

*Recoveries based on % of component in feed air stream.

Comments Regarding Examples 1, 2 and 3

The increased boilup and the nitrogen reflux in Examples 1 and 2 are obtained because all the feed air is fed at the bottom of the high pressure column, and all the nitrogen generated at the top is condensed against the liquid oxygen at the bottom of the high pressure column. This provides higher vapor flow in the bottom section of the low pressure column and a larger quantity of liquid nitrogen from the reboiler/condenser. The liquid nitrogen returned as reflux to the high pressure column is now higher than the one for the conventional low pressure cycle because in the proposed process, more air is rectified in the high pressure column. This provides an increased quantity of the crude liquid oxygen from the bottom of the high pressure column to be fed to the low pressure column as impure reflux. Furthermore, a larger quantity of liquid nitrogen is now available from the reboiler/condenser at the top of the high pressure column for reflux to the low pressure column. This increases the liquid flow in the top section of the low pressure column.

The above discussed effect is achieved because refrigeration is provided directly or indirectly through the oxygen stream from the bottom of the low pressure column. In the direct method, high pressure nitrogen vaporizes a moderate pressure oxygen stream which is then expanded for obtaining refrigeration. In the indirect method, liquid oxygen is let down in pressure and the high pressure nitrogen is condensed against this liquid after being expanded for refrigeration. Both methods retain the high boilup and reflux to the low pressure column.

It is important to point out that the process in the U.S. Pat. No. 4,822,395 also achieves a larger vapor flow in the bottom section of the low pressure column. It also feeds a much larger quantity of crude liquid oxygen to the low pressure column. However, its liquid nitrogen reflux to the low pressure column is less than that of the current invention. Therefore, the liquid flow in the section from the top of the low pressure column to the crude liquid oxygen feed point in this column is higher for the proposed processes. This key difference is responsible for the better performance of the current invention.

It is interesting to compare the results of Examples 1 and 2 with the example discussed in the U.S. Pat. No. 4,822,395. Table 3 compares the results. The recoveries for all the components in this text and Table 3 are defined as percent of the total amount present in the feed air stream which is recovered. Thus, if all the oxygen from the air were to be recovered, its recovery would be 100%. The prior art patented process produces oxygen with a recovery of 99.9% with purity of 99.75% as compared to 99.9% recovery with purity of 99.86% from the current examples. However, the recovery of nitrogen in the patented process was 94.6% as compared to 97.3% for the current example. This increase in nitrogen recovery is very important because these plants are primarily nitrogen producing plants designed for a fixed quantity of nitrogen product. This will decrease the power consumption of the process. Another important result is in argon recovery which is 94.4% and is significantly greater than 92.7% reported in the patent!

In summary, the processes of FIGS. 1 and 2 recover both nitrogen and argon with greater recoveries than the one taught in U.S. Pat. No. 4,822,395. It is worth noting that for both these processes, the major source of energy supply is the main air compressor. For the product slate discussed in these examples none of these processes require additional compression engergy. This makes the current processes more attractive due to higher nitrogen recoveries.

What is claimed is:

1. In a process for the separation of an air stream which comprises nitrogen, argon and oxygen in an integrated multi-column distillation system, having a higher pressure column, a lower pressure column and a side arm column for effecting separation of argon from oxygen, wherein the air stream is compressed, freed of impurities, and cooled forming a cooled air stream and then at least a portion is cryogenically distilled in an integrated multi-column distillation system having a higher pressure column, a lower pressure column, and a side arm column for separation of argon, and oxygen, nitrogen, and argon are obtained as products on removal from said multi-column distillation system the improvement for producing moderate pressure nitrogen product, having a pressure ranging from about 25 to 90 psia, while enhancing argon recovery which comprises:

a. feeding substantially all of the cooled air stream to the higher pressure column;

b. removing substantially all nitrogen vapor from the higher pressure column;

c. splitting the nitrogen vapor from the higher pressure column into two portions, a first portion being warmed against process streams, isentropically expanded, and condensed in a reboiler/condenser;

d. introducing a second portion of the nitrogen vapor to a reboiler/condenser in the lower pressure column for evaporating oxygen liquid and forming a condensed nitrogen stream;

e. isenthapically expanding the second portion and combining with the first portion to form a combined nitrogen stream;

f. introducing the combined nitrogen stream to an upper portion of the lower pressure column;

g. withdrawing a portion of oxygen liquid from the bottom of lower pressure column, isenthapically expanding, to form an oxygen stream and warming the oxygen stream against the first portion of nitrogen vapor in the reboiler/condenser in step (c);

h. warming the oxygen stream against process fluids and obtaining refrigeration therefrom; and, i. removing a waste nitrogen stream from an upper portion of the lower pressure column and warming against process fluids and recovering refrigeration therefrom j. removing moderate pressure nitrogen products at a pressure from 25–90 psia from the lower pressure column.

* * * * *